US009968183B1

(12) United States Patent
Forrest

(10) Patent No.: US 9,968,183 B1
(45) Date of Patent: May 15, 2018

(54) FINGERNAIL BRUSH HAVING ANGULARLY ADJUSTABLE BRISTLES

(71) Applicant: Andrea Forrest, St. Albans, VT (US)

(72) Inventor: Andrea Forrest, St. Albans, VT (US)

( * ) Notice: Subject to any disclaimer, the term of this patent is extended or adjusted under 35 U.S.C. 154(b) by 0 days. days.

(21) Appl. No.: 15/439,040

(22) Filed: Feb. 22, 2017

(51) Int. Cl.

| | |
|---|---|
| ***A46B 9/10*** | (2006.01) |
| ***A46B 5/02*** | (2006.01) |
| ***A46B 13/02*** | (2006.01) |
| ***A45D 29/17*** | (2006.01) |
| ***A46B 5/00*** | (2006.01) |

(52) U.S. Cl.
CPC ..... *A46B 9/10* (2013.01); *A45D 29/17* (2013.01); *A46B 5/0016* (2013.01); *A46B 13/023* (2013.01); *A46B 2200/1013* (2013.01)

(58) Field of Classification Search
CPC ..... A46B 9/10; A46B 5/0016; A46B 13/023; A46B 2200/1013; A45D 29/17
See application file for complete search history.

(56) References Cited

U.S. PATENT DOCUMENTS

| | | | | |
|---|---|---|---|---|
| 1,727,497 A | | 9/1929 | Zwick | |
| 3,216,034 A | | 11/1965 | Johnson | |
| 3,362,038 A | * | 1/1968 | Blount | A46B 15/00 15/144.1 |
| 3,966,335 A | | 6/1976 | Abramson | |
| 4,123,816 A | | 11/1978 | Lupo | |
| 4,321,723 A | * | 3/1982 | Kortick | A46B 7/026 15/184 |
| 4,510,954 A | | 4/1985 | Miller | |
| 5,640,979 A | | 6/1997 | Trenary | |
| 5,823,203 A | | 10/1998 | Carroll et al. | |
| 5,855,212 A | | 1/1999 | Walker | |
| 6,032,313 A | | 3/2000 | Tsang | |
| 6,314,964 B1 | | 11/2001 | Walker | |
| D454,250 S | | 3/2002 | Forrest | |
| 6,536,065 B2 | | 3/2003 | Forrest | |
| 6,990,984 B2 | | 1/2006 | O'Dwyer | |
| 8,201,565 B2 | | 6/2012 | Fernandez et al. | |

(Continued)

FOREIGN PATENT DOCUMENTS

| | | |
|---|---|---|
| AU | 2004203369 A1 | 2/2006 |
| CH | 301257 | 8/1954 |

(Continued)

*Primary Examiner* — Randall Chin
(74) *Attorney, Agent, or Firm* — Downs Rachlin Martin PLLC

(57) ABSTRACT

A fingernail brush that includes bristles that are angularly adjustable by a user of the brush. In one embodiment, the fingernail brush includes a housing and a bristle assembly having a bristle support and at least one row of bristles. The bristle assembly is rotatably coupled to the housing so that a user can rotate the bristles to a desired relative bristle angle. In some embodiments, the bristles are present in a bristle channel formed as a recess in a face of the housing. The angular adjustability of the bristles allows a user to set the bristles to a relative bristle angle appropriate for the way the user intends to orient their fingertips relative to the fingernail brush. In some embodiments, a fingernail brush of the present disclosure may include one or more vibration generators that cause bristles to vibrate at a sonic frequency, an ultrasonic frequency, or both, to enhance cleaning efficacy.

22 Claims, 4 Drawing Sheets

(56) References Cited

U.S. PATENT DOCUMENTS

| | | | | |
|---|---|---|---|---|
| 9,095,373 | B2 | 8/2015 | Guynn et al. | |
| 9,433,274 | B1 | 9/2016 | Morrison | |
| 2005/0155622 | A1 | 7/2005 | Leis | |
| 2006/0101597 | A1 | 5/2006 | Donnelly | |
| 2009/0282634 | A1* | 11/2009 | Pardini | A46B 5/0012 15/172 |
| 2011/0038660 | A1 | 2/2011 | Rudolph et al. | |
| 2015/0245703 | A1 | 9/2015 | Zelickson et al. | |
| 2015/0289636 | A1 | 10/2015 | Myers | |
| 2016/0058659 | A1 | 3/2016 | Angelov | |

FOREIGN PATENT DOCUMENTS

| | | | |
|---|---|---|---|
| CN | 203873207 | U | 10/2014 |
| DE | 2361008 | A1 | 6/1975 |
| DE | 8711620 | U1 | 12/1987 |
| DE | 3727649 | C1 | 11/1988 |
| DE | 29500565.3 | | 6/1995 |
| DE | 102013021673 | A1 | 6/2015 |
| FR | 2263722 | | 10/1975 |
| GB | 211233 | | 2/1924 |
| GB | 242586 | | 1/1926 |
| KR | 101071150 | B1 | 10/2011 |
| WO | 2009108952 | A1 | 9/2009 |

* cited by examiner

FINGERNAIL BRUSH HAVING ANGULARLY ADJUSTABLE BRISTLES

FIELD OF THE INVENTION

The present invention generally relates to the field of fingernail brushes. In particular, the present invention is directed to a fingernail brush having angularly adjustable bristles.

BACKGROUND

There are many occupations and circumstances in which people routinely get their hands, and particularly fingertips, heavily soiled. For example, commercial gardening, in the form of retail nurseries and those who provide gardening services at private homes, has become a large industry in the United States and other parts of the world. As the global economy has developed, more and more homeowners are relying upon professional gardening services to both supply them with shrubs and other provisions required for home gardening and to care for home gardens and lawns. Furthermore, notwithstanding the professional services used by homeowners, many homeowners themselves participate in gardening and yard care. In either case, the professional nursery personnel and homeowners often find themselves having hands and fingernails caked with soil and other yard matter, which, particularly if ignored, becomes increasingly difficult to remove. Examples of other occupations and circumstances in which people get their hands heavily soiled include automobile mechanics, construction workers, and industrial workers (e.g., steel mill workers), among many others.

Of course, standard soap and water provides a partially suitable solution to the problem of cleaning hands of the built-up soil but, nevertheless, virtually never quite completely removes all of the soil from hands and especially from around and under fingernails. Many types of hand-operated fingernail brushes are available for assisting people in cleaning dirt from their fingertips and particularly from crevices at the lateral margins of the fingernail plates and in the hyponychium regions under the front edges of the nails. The cleaning effectiveness of existing fingernail brushes varies from brush to brush, and improvements are still needed to increase fingernail brush cleaning effectiveness and increase their adaptability to the manner in which individual users tend to use the brushes.

SUMMARY OF THE DISCLOSURE

In an implementation, the present disclosure is directed to a fingernail brush that includes a housing sized and configured for gripping by a human hand, the housing includes a bristle opening, a bristle assembly that includes a bristle support pivotably secured within the housing so as to be pivotable about a pivot axis, and a first plurality of bristles secured to the bristle support so as to extend through the housing, and a bristle-angle-adjustment mechanism operatively configured to permit a user to adjust the plurality of bristles to a desired bristle sweep angle from among a plurality of bristle sweep angles and hold the first plurality of bristles at the desired bristle sweep angle.

BRIEF DESCRIPTION OF THE DRAWINGS

For the purpose of illustrating the invention, the drawings show aspects of one or more embodiments of the invention.

However, it should be understood that the present invention is not limited to the precise arrangements and instrumentalities shown in the drawings, wherein.

DETAILED DESCRIPTION

In some aspects, the present invention is directed to a fingernail brush that includes bristle tufts that are angularly adjustable by a user of the brush so that the user can optimize the cleaning ability of the brush for the particular fingertip configurations of that user. Fingertip configurations vary from person to person and from finger to finger (for the sake of this disclosure, a thumb is considered a finger for simplicity). For example: some people have relatively wide fingertips, while others have relatively narrow fingertips; some people have relatively thick finger pads, while others having relatively thin finger pads; some people have relatively curved nail plates, while others have relatively flat finger plates; and some people have relatively pointy fingertips, while others have relatively blunt fingertips. In addition, nail plate curvature and fingertip pointiness, for example, can vary from finger to finger on the same hand, such as from index finger to pinky finger. However, virtually all nailbrushes on the market today have fixed bristles, and, depending on the configuration of the nailbrushes, this fixed nature of the bristles on the brushes can lead to suboptimal cleaning for some fingertip configurations relative to other fingertip configurations. The present inventor has found that providing a fingernail brush with adjustable-angle bristles can be instrumental in providing users with more effective and efficient cleaning results. Examples of nailbrushes having angularly adjustable bristles are described below and a detailed example is illustrated in the accompanying drawings.

Figure 1:
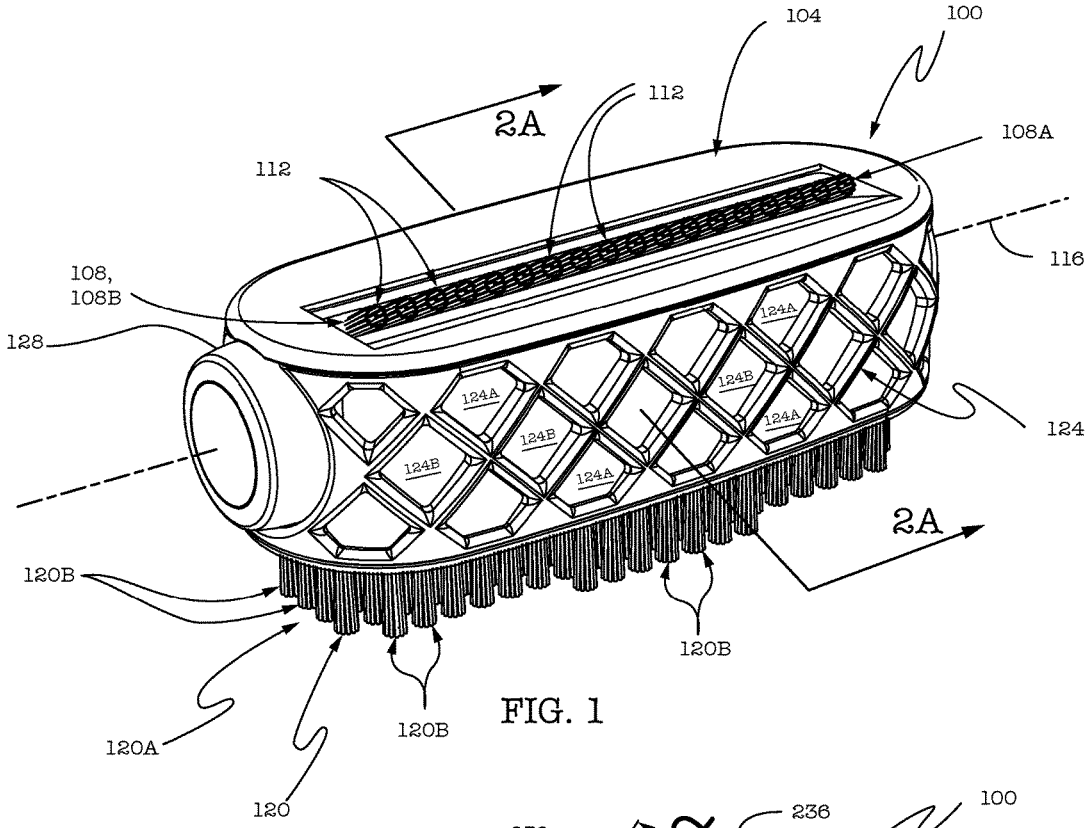
FIG. 1 is an isometric view of an exemplary fingernail brush having angularly adjustable bristles.

Referring now to the drawings, FIG. 1 illustrates a exemplary fingernail brush 100 that includes a body 104 and bristles 108 that, as described below, are angularly adjustable relative to the body by a user. In this example, angularly-adjustable bristles 108 are arranged into a plurality of tufts 112 (only a few labeled to avoid clutter) that are arranged in a single row 108A parallel to the longitudinal axis 116 of body 104 to form a first set 108B of bristles. It is noted that bristles 108 need not necessarily be arranged into tufts 112; for example, they may be arranged into a continuous row of bristles. It is also noted that bristles 108 may be provided in more than one row or may be provided in another arrangement, such as a single large tuft, concentric shapes, etc. That said, a single row of tufted bristles as illustrated in FIG. 1 can be beneficial so as to allow cleaning of multiple fingertips all at once. Bristles 108 are particularly arranged for cleaning beneath the free edges of the nail plates, as described below in further detail. Also in this example, fingernail brush 100 includes a second set 120A of bristles 120 arranged into tufts 120B (only a few labeled to avoid clutter) that are arranged into a plurality of eight rows 120C(1) to 120C(8) (FIG. 2A) parallel to longitudinal axis 116. Bristles 120, which may be fixed, vibratory, or a combination of fixed and vibratory, may be provided for more general finger cleaning operations, such as cleaning along the proximal, lateral, and distal nail folds, cleaning the upper portion of the nail plate, and/or cleaning finger pads, among other parts of the fingers.

Figure 2A:
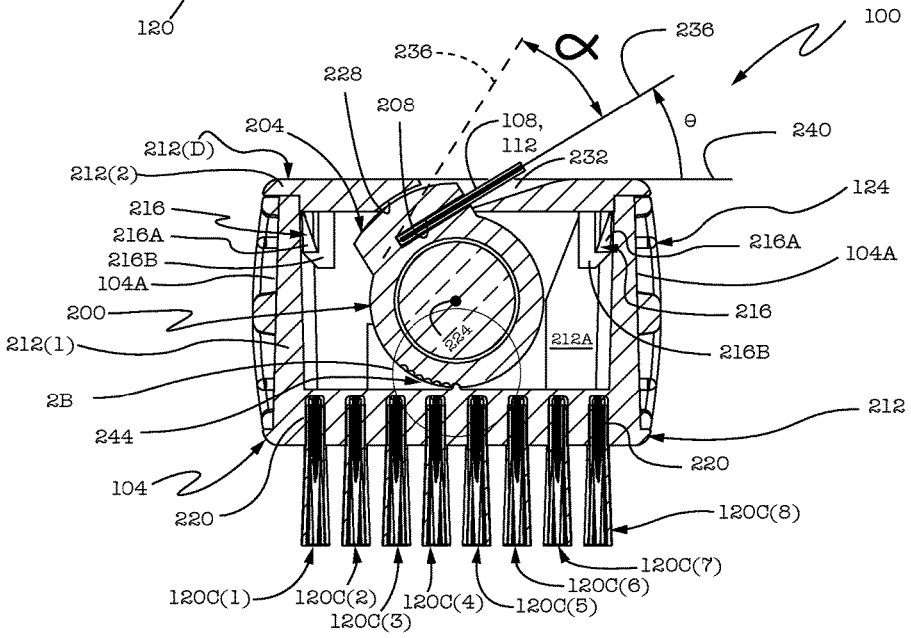
FIG. 2A is an enlarged transverse cross-sectional view as taken along line 2A-2A of FIG. 1.

Referring again to FIG. 1, body 104 in this embodiment is sized and configured to be readily grippable in one hand of a user while the user uses fingernail brush 100 to clean fingers on the user's other hand. To aid this grippability, body 104 of fingernail brush 100 includes a textured grip 124 on lateral surfaces 104A of the body (FIG. 2A). Here, textured grip 124 includes relatively deep diamond-shape recesses 124A, 124B (only a few labeled to avoid clutter) that can receive finger pads of user's hand to allow the user to firmly grip fingernail brush 100. Textured grip 124 may be made of the same material as other parts of body 104, such as plastic, or it may be made of another material, such as rubber, that improves grippability and feel. In other embodiments, textured grip 124 may have another suitable configuration or may not be provided at all.

FIG. 2A shows that in this embodiment bristles 108 are part of a bristle assembly 200 that includes a bristle support 204 having apertures 208 (only one seen in FIG. 2A) into which bristle tufts 112 (only one seen in FIG. 2A) are firmly engaged to hold them in place. In this embodiment, body 104 includes a housing 212 that defines an interior cavity 212A that houses a number of components of fingernail brush 100, including bristle support 204, among other things. This embodiment shows housing 212 as composed of two primary components, a main housing component 212(1) and a closure component 212(2) fixedly secured to the main housing component to close interior cavity 212A. In this example, closure component 212(2) is secured to main housing component 212(1) by catch-and-latch mechanisms 216 (two shown, though others may be present at other locations) that each have a catch 216A on the main housing component and a latch 216B on the closure component. Those skilled in the art will readily understand that the construction of housing 212 shown is merely exemplary and that many alternative constructions exist. For example, housing 212 may be split along any axis into two more or less equal components that join with one another or the housing may include a closure on an end or side, among other constructions. Fundamentally, there is no limitation on the construction of housing 212 as long as it achieves goals of the present invention. Similar to bristles 108 being firmly captured or seated in apertures 208 of bristle support 204, bristles 120 may likewise be firmly captured or seated in apertures 220 (only a couple labeled to avoid clutter) in main housing component 212(1).

In this embodiment, bristles 108 are angularly adjustable relative to housing 212 by virtue of bristle assembly 200 being rotatably mounted within interior cavity 212A of the housing so as to be rotatable about rotational axis 224. Bristle assembly 200 may be rotatably mounted within interior cavity 212A in any suitable manner, such as via rotational bearing surfaces (not shown) provided on main housing component 212(1) and/or on closure component 212(2). In this embodiment, bristles 108 extend through a bristle opening 228, here, in closure component 212(2), to the exterior of housing 212. Also in this embodiment, housing 212 includes a bristle channel 232, here, formed in closure component 212(2), that is configured for accommodating a bristle sweep angle $\alpha$, over a range of magnitudes. As used herein and in the appended claims, "bristle sweep angle $\alpha$" is the angle between an axis 236 parallel to each bristle 108 or tuft 112 of bristles when bristle assembly 200 is rotated to each of its maximum clockwise and counterclockwise extents. In the embodiment shown, bristle sweep angle $\alpha$ is about 30°. In other embodiments, bristle sweep angle $\alpha$ may be larger or smaller than 30° as desired to meet the requirements of a particular design. Given the orientations of axis 236 relative to the plane 240 of the outer face 212D of housing 212 when bristle assembly 200 is rotated to each of its maximum clockwise and counterclockwise extents, this bristle sweep angle translates into an adjustable relative bristle angle $\theta$ from about 25° to about 55°. Other embodiments having the same bristle sweep angle $\alpha$ of 30° can result in different values of relative bristle angles $\theta$ depending on the orientations of the maximum clockwise and counterclockwise extents of axis 236 relative to plane 240, as well as the orientation of plane 240 or other angle reference fixed relative to body 104 of fingernail brush 100.

Figure 2B:
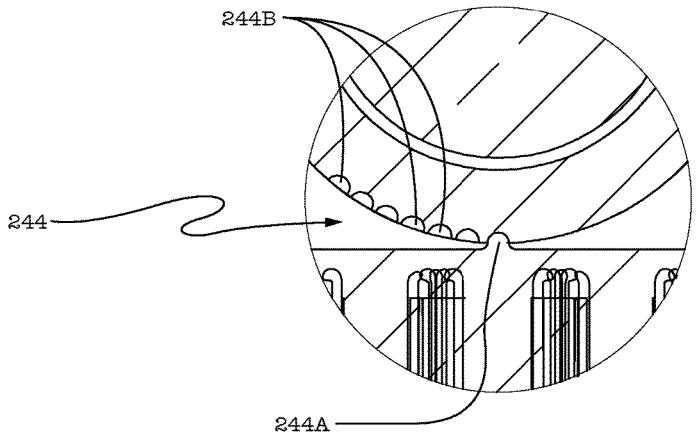
FIG. 2B is an enlarged partial section of the cross-sectional view of FIG. 2A illustrating the bristle-angle-adjustment mechanism of the fingernail brush of FIG. 1.

With continuing reference to FIG. 2A, and also reference to FIG. 2B, fingernail brush 100 includes a bristle-angle-adjustment mechanism 244 designed and configured to permit a user to adjust bristle sweep angle $\alpha$ and, correspondingly, relative bristle angle $\theta$, to desired angles. In the embodiment shown, bristle-angle-adjustment mechanism 244 comprises a detent mechanism having stop boss 244A (FIG. 2B) on main housing component 212(1) and a plurality of detent receivers 244B (only a few labeled to avoid clutter) each designed and configured to conformally and snugly receive the stop boss when bristle assembly 200 is correspondingly rotated. When stop boss 244A is engaged with one of detent receivers 244B, this engagement firmly inhibits bristle assembly 200 from rotating until the user desires to change bristle sweep angle $\alpha$ and, correspondingly, adjustable relative bristle angle $\theta$. In the embodiment shown and referring to FIG. 1, bristle-angle-adjustment mechanism 244 includes a knob 128 external to body 104 that is fixedly secured to bristle assembly 200 (FIG. 2A) so that when a user rotates the knob, the bristle assembly also rotates to change bristle sweep angle $\alpha$ and relative bristle angle $\theta$ (FIG. 2A), as well as to change the corresponding one of detent receivers 244B engaged by stop boss 244A.

In another embodiment that does not include external knob 128 (FIG. 1), a user may change bristle sweep angle $\alpha$ and, correspondingly, relative bristle angle $\theta$, by grasping body 104 (FIG. 2A) in one hand and bristles 108 in the other hand, pulling bristle assembly 200 away from stop boss 244A so as to effectively disengage the stop boss from the corresponding stop receiver 244B, and, while continuing to pull the bristle assembly away from the stop boss, rotate the bristle assembly so that the axis 236 is at the desired relative bristle angle $\theta$ and release tension on the bristles so that the stop boss seats in the corresponding boss receiver.

It is noted that bristle-angle-adjustment mechanism 244 is merely exemplary; any of a wide variety of bristle-angle-adjustment mechanisms can be used in place of bristle-angle-adjustment mechanism 244 shown. For example, the components on which stop boss 244A and boss receivers 244B are present. That is, stop boss 244A can be present on bristle assembly 200 and boss receivers 244B can be present on housing 212 or a structure, for example, curved cradle (not shown) fixed to housing. As another example, fixed stop boss 244A can be replaced with a sprung pin arrangement (not shown) in which the spring(s) is/are tuned to permit a user to rotate bristle assembly 200 only when the user exerts a sufficiently large force that is larger than any forces that would be exerted on the bristle assembly during normal fingernail cleaning operations. As yet another example, fixed stop boss 244A can be replaced with a movable pin (not shown) and a pin-release mechanism (not shown), such as a push-button release, that allows the pin to retract from a pin receiver (like a boss receiver 244B) to allow the user to rotate bristle assembly 200. As yet a further example, the bristle-angle-adjustment mechanism may be a cogwheel-pawl mechanism. Many other bristle-angle-adjustment mechanisms can similarly be used in place of bristle-angle-adjustment mechanism 244 without undue experimentation.

Figure 3:
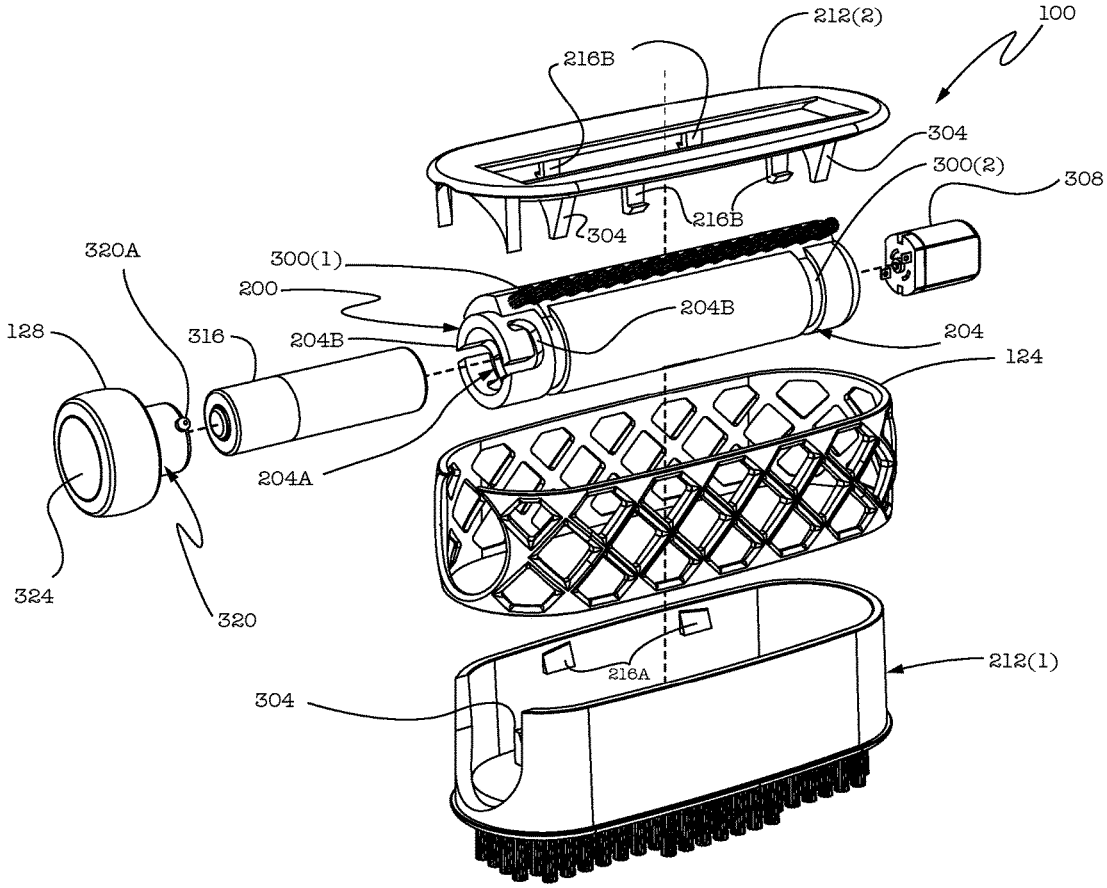
FIG. 3 is an exploded perspective view of the fingernail brush of FIG. 1.

FIG. 3 illustrates additional construction details of fingernail brush 100 of FIG. 1. For example, FIG. 3 shows additional features of bristle support 204, including grooves 300(1) and 300(2) that engaged four corresponding bearings 304, two on closure component 212(2) of housing 212 and two on main housing component 201(1) (only one seen) so as hold bristle assembly 200 in position when fingernail brush 100 is assembled. FIG. 3 also shows catches 216A and latches 216B in more detail, and that textured grip 124 is separate from the housing 212. In this example, textured grip 124 is made of an elastomeric material that is in tension when applied to main housing component 212(1).

In the embodiment shown, fingernail brush 100 is designed and configured to vibrate bristles 108 of bristle assembly 200 at one or more sonic and/or ultrasonic frequencies when the user desires to activate such vibratory functionality. In this connection, the illustrated embodiment includes at least one vibration generator 308 suitably fixed or coupled to bristle support 204 to cause the bristle support, and consequently bristles 108, to vibrate at one or more sonic and/or ultrasonic frequencies to enhance the cleaning effectiveness of fingernail brush 100. Each vibration generator 308 provided may be powered by electricity, such as from one or more onboard batteries, here a single battery 312, or other electrical power source. As an example in the sonic frequency range, vibration generator(s) 308 may comprise a rotary electric motor (not shown) that drives an eccentric weight, such as a relatively massive solid disk (made of, e.g., metal) (not shown) with a sector removed or other eccentric weighting configuration. In this example, the rotary electric motor may operate at a speed, in revolutions per second (rps), in the sonic frequency realm (e.g., 60 Hz), such that the spinning of the eccentric weight by the rotary electric motor causes entire bristle assembly 200 to vibrate at that sonic frequency. As an example in the ultrasonic frequency range, vibration generator(s) 308 may comprise a piezoelectric generator designed and configured to generate vibrations at one or more frequencies above 20,000 Hz. Examples of mechanisms that can be implemented in a fingernail brush of the present disclosure are disclosed in U.S. Pat. No. 6,536,065 titled "MULTI-BRUSH ULTRASONIC NAIL CLEANER", issued on Mar. 25, 2003, to Andrea Forrest, which is incorporated herein by reference for its disclosure of incorporating ultrasonic-frequency vibration mechanisms into a fingernail brush. Those skilled in the art will readily appreciate how to adapt the ultrasonic-frequency vibration mechanisms of the '065 patent to a fingernail brush made in accordance with the present disclosure, such as fingernail brush 100 of FIGS. 1 to 3.

Vibration generator(s) 308 is/are fixedly mounted inside bristle support 204 so that when fingernail brush 100 is assembled and the vibration generator(s) is/are operating, the bristle support and bristles 108 are vibrated by the vibration generator(s). This vibration enhances the cleaning efficacy of fingernail brush 100. In some embodiments, vibration generator(s) 308 may include both sonic and ultrasonic vibration generators, which may be turned on and off individually or simultaneously with one another. In some embodiments, fingernail brush 100 may not include any vibration generators and, therefore, not need any motor(s) and battery(ies).

As can also be seen in FIG. 3, bristle support 204 of bristle assembly 200 includes a battery compartment 204A that houses a battery 316, for example, a single 1.5V AA battery. Battery compartment 204A is sealed by a closure 320 that secures to bristle support 204 by a pair of suitable J-shape camming slots 204B that receive corresponding respective cam pins 320A (only one visible). As those skilled in the art will readily understand, engaging closure with J-shape camming slots 204B works against a biasing spring (not shown) within battery compartment 204A. Knob 128 is integrated with closure 320, as is an electrical switch 324 that allows a user to turn the vibratory functionality on and off as desired.

Figure 4:
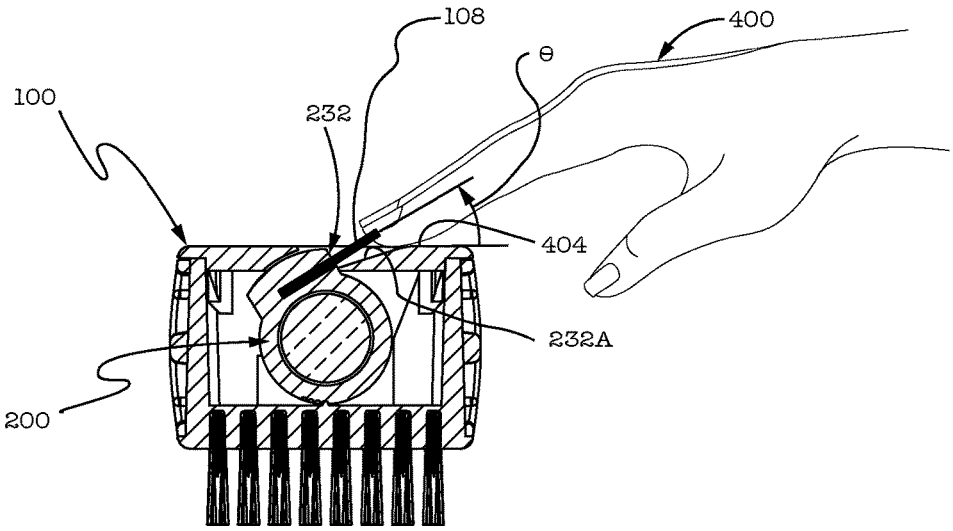
FIG. 4 is a diagram illustrating the fingernail brush of FIGS. 1-3 in a fingernail cleaning scenario in which a user has their finger oriented so that the finger pad is resting on the bristle channel, showing the relative bristle angle being relatively small.
Figure 5:
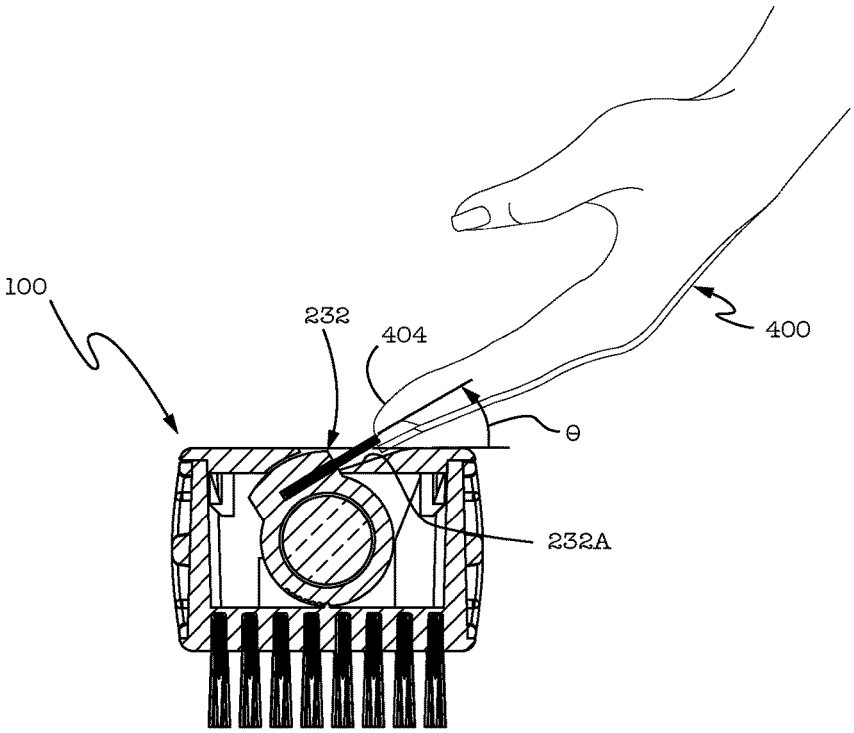
FIG. 5 is a diagram illustrating the fingernail brush of FIGS. 1-3 in a fingernail cleaning scenario in which a user has their finger oriented so that their fingernail is nearly resting on the bristle channel, showing the relative bristle angle being relatively small.
Figure 6:
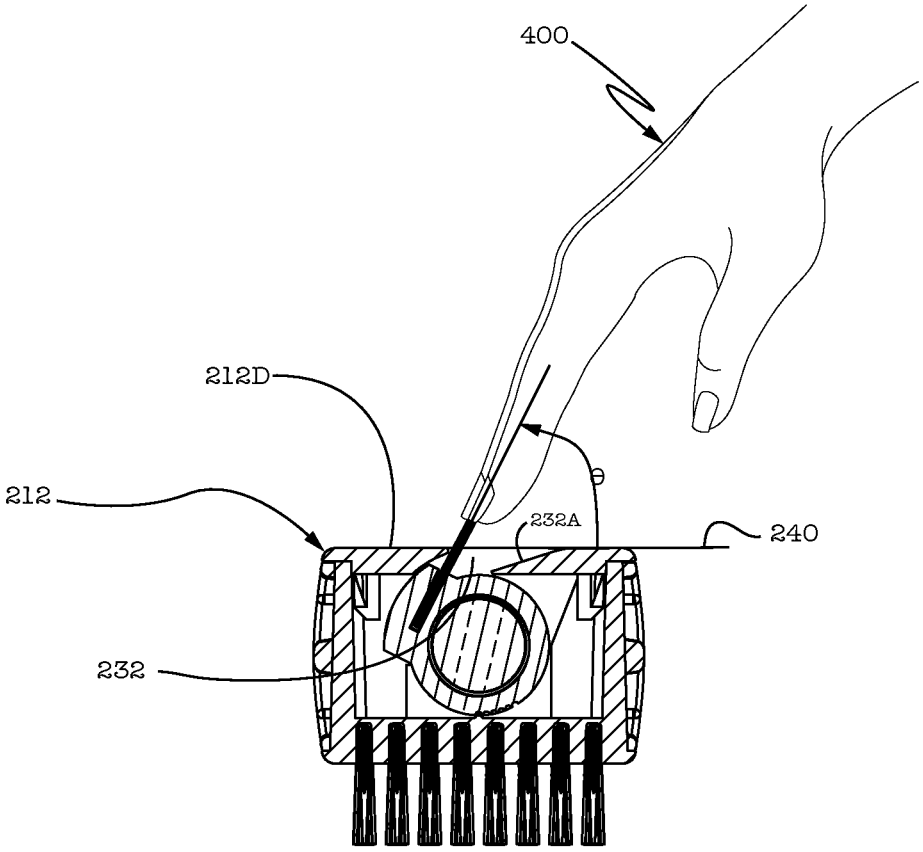
FIG. 6 is diagram illustrating the fingernail brush of FIGS. 1-3 in a fingernail cleaning scenario in which a user has their finger oriented largely perpendicular to the upper surface of the fingernail brush.

FIGS. 4 to 6 illustrate three fingernail cleaning scenarios involving angularly adjustable bristles 108 of fingernail brush 100 of FIGS. 1-3. In the scenario of FIG. 4, a user 400 has their finger pads 404 resting on surface 232A of bristle channel 232. In this example, the user's finger pads 404 are relatively thin, which allows user 400 to use adjustable bristle assembly 200 to a fairly small relative bristle angle θ. Because of the relative thinness of finger pads 404, user 400 can place the free edges of their fingernails relatively close to surface 232A of bristle channel 232 (as measured perpendicularly to surface 232A), such that relative bristle angle θ can be relatively small while allowing bristles 108 to make effective contact with the hyponychium regions of the fingertips. If, however, user 400 were to have relatively thick finger pads (not shown) that would place the free edges of their fingernails farther from surface 232A, the user may desire to set relative bristle angle θ to a greater angle than shown in FIG. 4 to allow bristles to make effective contact with the hyponychium regions of the fingertips.

As can be seen in FIG. 4, user 400 is using fingernail brush 100 with their finger pads 404 in contact with surface 232A of bristle channel 232. However, a user, such as user 400, can decide to use bristles 108 of fingernail brush 100 differently. For example, as seen in FIG. 5, user 400 can place their nail plates proximate to or against surface 232A of bristle channel 232. In this case, user 400 can adjust relative bristle angle θ close to or at its minimum value to allow bristles 108 to make effective contact with the hyponychium regions of fingertips. As another example, FIG. 6 shows that user 400 does not need to place their fingers close to surface 232A of bristle channel 232. Rather, user 400 may desire to position their fingers more perpendicular to plane 240 of outer face 212D of housing 212, in which case the user would want to make relative bristle angle θ relatively large to allow bristles 108 to make effective contact with the hyponychium regions of the fingertips. Of course, other fingernail-cleaning scenarios are possible for the use of the angular adjustability of bristles 108.

Those skilled in the art will readily appreciate that fingernail brush 100 described above and illustrated in the accompanying drawings are merely exemplary as alluded to above. Any one or more of the foregoing and other alternatives can be implemented without straying from the fundamental principles of a fingernail brush made in accordance with the present disclosure.

The foregoing has been a detailed description of illustrative embodiments of the invention. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A fingernail brush, comprising:

a housing sized and configured for gripping by a human hand, the housing comprising a bristle opening;

a bristle assembly that includes:

a bristle support pivotably secured within the housing so as to be pivotable about a pivot axis; and a first plurality of bristles secured to the bristle support so as to extend through the housing; and a bristle-angle-adjustment mechanism operatively configured to permit a user to adjust the plurality of bristles to a desired bristle sweep angle from among a plurality of bristle sweep angles and hold the first plurality of bristles at the desired bristle sweep angle;

further comprising a vibration generator operatively connected to the bristle assembly to as to impart sonic vibration into the first plurality of bristles when the vibration generator is operating.

2. The fingernail brush according to claim 1, wherein the vibration generator comprises an electric rotary motor that drives and eccentric weight to cause the vibration when the electric rotary motor is operating.

3. The fingernail brush according to claim 2, wherein the bristle support is cylindrical and the electric rotary motor and eccentric weight are mounted to the bristle support inside the bristle support.

4. The fingernail brush according to claim 3, wherein the bristle support contains a battery compartment for containing a battery for powering the electric rotary motor.

5. The fingernail brush according to claim 4, further comprising a battery compartment closure having a portion external to the housing.

6. The fingernail brush according to claim 5, wherein the battery compartment closure provides a knob that allows a user to rotate bristle support assembly so as to change the desired bristle sweep angle.

7. The fingernail brush according to claim 6, wherein the battery compartment closure has an end distal from the battery compartment, the fingernail brush further comprising an electrical button switch that selectively completes and breaks an electrical circuit containing the battery when present and the electric rotary motor.

8. The fingernail brush according to claim 1, further comprising a ultrasonic vibration generator in operative communication with the first plurality of bristles to cause the first plurality of bristles to vibrate at an ultrasonic frequency.

9. The fingernail brush according to claim 1 wherein the bristle-angle-adjustment mechanism includes a detent mechanism.

10. The fingernail brush according to claim 1, wherein the bristle-angle-adjustment mechanism includes a knob for control by the user.

11. The fingernail brush according to claim 1, wherein the bristle support is generally cylindrical and the first plurality of bristles are secured to the bristle support in a tangential orientation.

12. The fingernail brush according to claim 11, wherein the first plurality of bristles are arranged in a plurality of tufts arranged along a single line parallel to the pivot axis of the bristle support.

13. The fingernail brush according to claim 11, wherein the first plurality of bristles are arranged in a continuous single line parallel to the pivot axis of the bristle support.

14. The fingernail brush according to claim 1, wherein the housing has a first face and a second face spaced from the first face, the first face including the bristle opening, wherein the fingernail brush further includes a second plurality of bristles extending from the second face of the housing.

15. The fingernail brush according to claim 14, wherein the first plurality of bristles are arranged in a first plurality of tufts arranged along a single line parallel to the pivot axis and the second plurality of bristles are arranged in a second plurality of tufts arranged in a two dimensional pattern on the second face.

16. The fingernail brush according to claim 15, wherein the first face includes a recessed bristle channel and the first plurality of bristles extend through the housing into the recessed bristle channel.

17. The fingernail brush according to claim 1, wherein the housing includes a face containing the bristle opening, and the bristle-angle-adjustment mechanism is operatively configured to permit a user to adjust a desired relative bristle angle from less than 25° relative to the face and greater than 50° relative to the face.

18. The fingernail brush according to claim 1, wherein the housing includes a first face containing the bristle opening, the first face further including a recessed bristle channel and the first plurality of bristles extend through the housing into the bristle channel.

19. The fingernail brush according to claim 18, wherein the housing has a second face spaced from said first face by lateral sides, the fingernail brush further including a grip on the lateral sides, wherein the grip includes a plurality of diamond shaped recesses sized to receive portions of fingertip pads of a human user.

20. A fingernail brush, comprising:

a housing sized and configured for gripping by a human hand, the housing comprising a bristle opening;

a bristle assembly that includes:

a bristle support pivotably secured within the housing so as to be pivotable about a pivot axis; and a first plurality of bristles secured to the bristle support so as to extend through the housing; and a bristle-angle-adjustment mechanism operatively configured to permit a user to adjust the plurality of bristles to a desired bristle sweep angle from among a plurality of bristle sweep angles and hold the first plurality of bristles at the desired bristle sweep angle;

further comprising a ultrasonic vibration generator in operative communication with the first plurality of bristles to cause the first plurality of bristles to vibrate at an ultrasonic frequency.

21. A fingernail brush, comprising:

a housing sized and configured for gripping by a human hand, the housing comprising a bristle opening;

a bristle assembly that includes:

a bristle support pivotably secured within the housing so as to be pivotable about a pivot axis; and a first plurality of bristles secured to the bristle support so as to extend through the housing; and a bristle-angle-adjustment mechanism operatively configured to permit a user to adjust the plurality of bristles to a desired bristle sweep angle from among a plurality of bristle sweep angles and hold the first plurality of bristles at the desired bristle sweep angle;

wherein:

the housing has a first face and a second face spaced from the first face, the first face including the bristle opening, wherein the fingernail brush further includes a second plurality of bristles extending from the second face of the housing;

the first plurality of bristles are arranged in a first plurality of tufts arranged along a single line parallel to the pivot axis and the second plurality of bristles are arranged in a second plurality of tufts arranged in a two dimensional pattern on the second face; and the first face includes a recessed bristle channel and the first plurality of bristles extend through the housing into the recessed bristle channel.

22. A fingernail brush, comprising:

a housing sized and configured for gripping by a human hand, the housing comprising a bristle opening;

a bristle assembly that includes:

a bristle support pivotably secured within the housing so as to be pivotable about a pivot axis; and a first plurality of bristles secured to the bristle support so as to extend through the housing; and a bristle-angle-adjustment mechanism operatively configured to permit a user to adjust the plurality of bristles to a desired bristle sweep angle from among a plurality of bristle sweep angles and hold the first plurality of bristles at the desired bristle sweep angle;

wherein:

the housing includes a first face containing the bristle opening, the first face further including a recessed bristle channel and the first plurality of bristles extend through the housing into the bristle channel; and the housing has a second face spaced from said first face by lateral sides, the fingernail brush further including a grip on the lateral sides, wherein the grip includes a plurality of diamond shaped recesses sized to receive portions of fingertip pads of a human user.

* * * * *